US006214197B1

(12) United States Patent
Kimizuka et al.

(10) Patent No.: US 6,214,197 B1
(45) Date of Patent: Apr. 10, 2001

(54) PROCESS FOR PRODUCING PERSULFATE

(75) Inventors: Ken-ichi Kimizuka; Shoichiro Kajiwara; Takamitsu Tsuruga, all of Kanagawa-ken (JP)

(73) Assignee: Mitsubishi Gas Chemical Company, Inc., Tokyo (JP)

( * ) Notice: Subject to any disclaimer, the term of this patent is extended or adjusted under 35 U.S.C. 154(b) by 0 days.

(21) Appl. No.: 09/275,026

(22) Filed: Mar. 24, 1999

(30) Foreign Application Priority Data

Mar. 30, 1998 (JP) ..... 10-084220
Apr. 7, 1998 (JP) ..... 10-094700
Apr. 7, 1998 (JP) ..... 10-094701

(51) Int. Cl.[7] ..... C25B 1/28
(52) U.S. Cl. ..... 205/471; 205/472
(58) Field of Search ..... 205/471, 472

(56) References Cited

U.S. PATENT DOCUMENTS 4,144,144 * 3/1979 Radimer et al. ..... 205/347
5,445,717 * 8/1995 Karki et al. ..... 205/471
5,958,208 * 9/1999 Thiele et al. ..... 205/471

* cited by examiner

*Primary Examiner*—Arun S. Phasge
(74) *Attorney, Agent, or Firm*—Antonelli, Terry, Stout & Kraus, LLP

(57) ABSTRACT

There are disclosed (1) a process for producing ammonium persulfate which comprises electrolyzing, as the starting raw material for an anode, an aqueous solution containing ammonium sulfate wherein ammonium ions are present in an amount of at least one equivalent based on sulfate ions; (2) a process for producing sodium persulfate which comprises the step (A) of electrolyzing an aqueous solution containing ammonium sulfate at an anode, the step (B) of producing sodium persulfate, the step (C) of crystallizing and separating the sodium persulfate and the step (D) of recycling the liquid produced at a cathode together with ammonia for use as the starting raw material for an anode in the step (A); and (3) a process for producing potassium persulfate which comprises the step (A') of electrolyzing an aqueous solution containing ammonium sulfate at an anode; and the step (B') of producing potassium persulfate. The above processes are capable of effectively producing respective persulfates in an industrially advantageous manner.

25 Claims, No Drawings

PROCESS FOR PRODUCING PERSULFATE

BACKGROUND OF THE INVENTION

1. Field of the Invention

The present invention relates to a process for producing a persulfate such as ammonium persulfate, sodium persulfate and potassium persulfate. More particularly, the present invention is concerned with an industrially advantageous process for efficiently producing a persulfate such as ammonium persulfate, sodium persulfate and potassium persulfate that are widely employed as a polymerization initiator for polyvinyl chloride and polyacrylonitrile and as a treatment agent for a printed wiring board.

2. Description of the Related Arts

Ammonium persulfate, sodium persulfate and potassium persulfate are industrially important compounds that are widely employed as a polymerization initiator for various polymers including in particular, polyvinyl chloride and polyacrylonitrile, and as a treatment agent for a printed wiring board. As a general process for producing ammonium persulfate, there is known an electrolytic production process by the use of, as a starting raw material, an aqueous solution containing sulfuric acid and ammonium sulfate, that is, an aqueous solution of ammonium hydrogensulfate. In the above-stated process, ammonium persulfate is produced by an electrolytic production process, and the resultant ammonium persulfate is concentrated, separated and dried by vacuum crystallization, centrifugal filtration or the like to obtain a finished product. At this time, the solution containing the crystal (usually referred to as"mother liquor ") is mixed with the liquid produced at a cathode and is used as a starting raw material for an anode.

For instance, Japanese Patent Application Laid-Open No.34700/1980 (Sho-55) discloses a process for producing an alkali salt or an ammonium salt of persulfuric acid by the anodic oxidation, in a diaphragm cell, of an aqueous solution containing sulfate ions including a proton, alkali metal ions or ammonium ions. This process, however is not economical because of a low current efficiency being at most 80% , approximately in the final electrolysis. In addition, Japanese Patent Application Laid-Open No.198275/1982 (Sho-57) discloses a process for producing ammonium persulfate by the use of ammonium hydrogensulfate and an electrolysis accelerator. This process, however as is the case with the foregoing, can not be said to be economical because of a low current efficiency being at most 80% approximately in the final electrolysis.

On the other hand, as a general process for producing sodium persulfate or potassium persulfate, there is known a production process by the reaction of ammonium persulfate and sodium hydroxide or potassium hydroxide in the aqueous solution. It is necessary in the above-mentioned process that in the first place ammonium persulfate as a starting raw material be produced by electrolysis method, and the resultant ammonium persulfate be concentrated and separated by vacuum crystallization, centrifugal filtration or the like and then taken out as a crystal. At the same time, the solution having contained the crystal, as is the case with the foregoing, is mixed with the liquid produced at a cathode and is used as a starting raw material for an anode.

The ammonium persulfate in the form of crystal thus obtained is re-dissolved in the next step, and is transferred to the step of reaction with sodium hydroxide or potassium hydroxide. In the aforesaid reaction step, a solution containing sodium persulfate or potassium persulfate is produced, then is concentrated and separated by vacuum crystallization, centrifugal filtration or the like and is subsequently taken out as a crystal. As stated hereinbefore, the process for producing sodium persulfate or potassium persulfate by the reaction of ammonium persulfate and sodium hydroxide or potassium hydroxide necessitates quite a long production steps and a number of steps and moreover, lowers the yield of the objective sodium persulfate or potassium persulfate based on the ammonium persulfate, thereby making itself far from economically advantageous.

Under such circumstances, several attempts have been made to produce sodium persulfate and potassium persulfate by the direct electrolysis without passing through ammonium persulfate. For instance, Japanese Patent Application Laid-Open No. 56395/1975 (Sho-50) discloses a process for producing sodium persulfate by the use of sodium hydrogensulfate as a starting raw material, which process, however is impractical because of an extremely low current efficiency in the electrolysis. Moreover, Japanese Patent Application Laid-Open No.133196/1975 (Sho-50) discloses a process for producing potassium persulfate by the use of potassium hydrogensulfate as a starting raw material, which process, however is impractical because of an extremely low current efficiency in the electrolysis in spite of the necessity for the use of a special electrolytic cell and expensive titanium-made cathodes.

In addition, Japanese Patent Publication No. 31190/1980 (Sho-55) discloses a process for producing sodium persulfate by means of electrolysis through the use of a neutral starting raw material for an anode in the presence of ammonium ions, which process, however can not be said to be economical because of a low current efficiency being about 70 to 80% in the electrolysis. Further, the aforesaid process suffers such disadvantages that the ammonium ions contained in the objective crystal increase the content of nitrogen components in the objective sodium persulfate and that the process necessitates a minute and attentive cleaning step in order to satisfy the ordinary requirement for the quality of sodium persulfate as the finished product, namely a purity of at least 99% by weight and the content of nitrogen components of at most 0.1% by weight.

In spite of a number of efforts and endeavors having heretofore been directed towards the improvement of the production process, it is the real situation that an economical process for producing sodium persulfate or potassium persulfate has not yet been developed.

SUMMARY OF THE INVENTION

Under such circumstances, a first object of the present invention is to solve the problems involved in the conventional processes for producing ammonium persulfate as described hereinbefore, and at the same time to provide an industrially advantageous process for producing ammonium persulfate at a high current efficiency in electrolysis.

A second object of the present invention is to solve the problems involved in the conventional processes for producing sodium persulfate as described hereinbefore, and at the same time to provide an industrially advantageous process which is free from troublesome steps and further is capable of producing highly pure sodium persulfate at a high current efficiency in electrolysis.

A third object of the present invention is to solve the problems involved in the conventional processes for producing potassium persulfate as described hereinbefore, and at the same time to provide an industrially advantageous process which is free from troublesome steps at a high current efficiency in electrolysis.

As the result of intensive extensive research and development carried out by the present inventors in order to achieve the above-mentioned objects, it has been found that the current efficiency at the time of producing ammonium persulfate is markedly enhanced, the production efficiency thereof is enhanced, and thus the above-mentioned first object of the present invention is achievable by a method which comprises electrolyzing a starting raw material for an anode containing an aqueous solution of ammonium sulfate wherein ammonium ions are present in an amount of at least one equivalent (two-fold moles) based on sulfate ions, that is, an aqueous solution of ammonium sulfate wherein the sulfate ions originate only from ammonium sulfate; then crystallizing ammonium persulfate, and separating mother liquor from the crystal, particularly preferably by the above-mentioned method in which said starting raw material for an anode is produced by neutralizing, with ammonia, the mixture of the liquid produced at a cathode and said mother liquor.

In addition, it has been found thereby that the above-mentioned second object of the present invention is achievable by a method which comprises electrolyzing an aqueous solution containing ammonium sulfate at an anode; reacting the liquid produced at the anode directly with sodium hydroxide to form sodium persulfate; then crystallizing sodium persulfate; and separating mother liquor from the crystal, while recycling the liquid produced at a cathode together with ammonia to the starting raw material for the anode in the electrolysis step, and particularly preferably by the aforesaid method which further comprises recycling, to the sodium persulfate production step, at least part of the solution formed by removing sodium sulfate from the mother liquor formed after crystallizing separating the sodium persulfate.

Moreover, it has been found thereby that the above-mentioned third object of the present invention is achievable by a method which comprises electrolyzing an aqueous solution containing ammonium sulfate at an anode; reacting the liquid produced at the anode directly with potassium hydroxide to form potassium persulfate; then crystallizing potassium persulfate; and separating mother liquor from the crystal, and particularly preferably by the aforesaid method which further comprises using the liquid produced at a cathode together with ammonia as the starting raw material for the anode in the electrolysis step, or recycling, to the potassium persulfate production step, at least part of the mother liquor formed after crystallizing separating the potassium persulfate.

The present invention has been accomplished by the foregoing findings and information.

Specifically, the first object of the present invention is attained by a process for producing ammonium persulfate which comprises electrolyzing an aqueous solution containing sulfate ions and ammonium ions as the starting raw material for an anode, then crystallizing the electrolyzed product, and separating the crystal, said sulfate ions in said aqueous solution being derived only from ammonium sulfate, and particularly preferably further comprises neutralizing the mixture of the liquid produced at a cathode and the mother liquor, using the neutralized product as the starting raw material for the anode.

The second object of the present invention is attained by a process for producing sodium persulfate which comprises the step (A) of electrolyzing an aqueous solution containing ammonium sulfate at an anode; the step (B) of producing sodium persulfate from the liquid produced at the anode as obtained in the preceding step (A) and sodium hydroxide; the step (C) of crystallizing the aqueous solution containing sodium persulfate as obtained in the preceding step (B), and separating the resultant crystal from mother liquor; and the step (D) of recycling the liquid produced at a cathode together with ammonia to the starting raw material for the anode in the step (A), and particularly preferably further comprises recycling, to the step (B), at least part of the solution formed by removing sodium sulfate from the mother liquor formed in the step (C).

The third object of the present invention is attained by a process for producing potassium persulfate which comprises the step (A') of electrolyzing an aqueous solution containing ammonium sulfate at an anode; and the step (B') of producing potassium persulfate from the liquid produced at the anode as obtained in the step (A') and potassium hydroxide, and particularly preferably further comprises using the liquid produced at a cathode together with ammonia as the starting raw material for the anode in the step (A'), or recycling, to the step (B'), at least part of mother liquor formed after crystallizing the aqueous solution containing potassium persulfate and separating the crystal.

DESCRIPTION OF THE PREFERRED EMBODIMENTS

In the following at first, detailed description will be given of the process for producing ammonium persulfate according to the present invention. In the production process of ammonium persulfate according to the present invention, there is used, as a starting raw material for an anode in the electrolysis step, an aqueous solution of ammonium sulfate in which the sulfate ions are derived only from ammonium sulfate, namely an aqueous solution of ammonium sulfate in which the ammonium ions are present in an amount of at least one equivalent (two-fold moles) based on the sulfate ions. Consequently, the aforesaid aqueous solution is free from free sulfuric acid, and the sulfate ions originate only from ammonium sulfate.

The above-mentioned aqueous solution of ammonium sulfate to be used as the starting raw material for an anode in the electrolysis step, has a content of ammonium sulfate being preferably in the range of 30 to 44% by weight, particularly preferably in the range of 40 to 44% by weight. The starting raw material for the anode contains a necessary amount of a polarizer, which is exemplified by thiocyanate, cyanide, cyanate and fluoride. There is used as a starting raw material for a cathode, about 10 to 80% by weight of an aqueous solution of sulfuric acid containing ammonium sulfate having a concentration range of about 0 to 35% by weight. The use of the aqueous solution as the starting raw material for a cathode or an anode having a concentration outside the aforesaid range is disadvantageous because of a low current efficiency obtained therefrom.

The electrolytic cell to be used for the process in the invention is preferably either a diaphragm cell which is partitioned with an alumina diaphragm, etc. and is widely industrially used, or a filter press-type electrolytic cell which is partitioned with ion exchange membranes, etc. The anode is constituted preferably of platinum, and there is usable a material having chemical resistance such as a carbon electrode. The cathode is constituted preferably of lead or zirconium, and there is usable a metallic electrode having acid resistance such as stainless steel. The current density of the surface of the anode is preferably at least 40 A/dm$^2$. The temperature inside an electrolytic cell is preferably 15 to 40° C . The temperature therein, when being lower than said range, causes a fear of salt deposition from the solution. The solubility of a salt increases with a rise in the temperature of the solution, but an unreasonably high temperature therein is unfavorable because of the liability of the produced persulfate to hydrolysis reaction.

The liquid produced at the anode after the electrolysis is subjected to concentration and crystallization. As the crystallizer for subjecting said liquid to concentration and crystallization, there is employed a tank type crystallizer which is widely and generally used. The crystallization temperature is preferably 15 to 60° C., more preferably 20 to 50° C. The crystallization temperature, when being lower than said range, is economically disadvantageous since the temperature of the condenser portion is made unreasonably low, whereas the temperature, when being higher than said range, is also unfavorable because of the decomposition of the objective ammonium persulfate thus bringing about a fear of lowering the yield thereof. As the crystallization pressure, there is preferably adopted a pressure at which water boils in the above-mentioned temperature range. The slurry containing the ammonium persulfate after the crystallization, is separated into crystal and mother liquor by the use of a solid liquid separator such as a centrifugal filter. The crystal thus obtained is dried and made into a finished product usually by using a powder dryer.

On the other hand, it is industrially advantageous in the process according to the present invention to mix the mother liquor thus separated with the liquid produced at the cathode, neutralize the resultant mixture with ammonia, and subsequently employ the neutralized product as the starting raw material for the anode in the electrolysis step. In the neutralization step, ammonia is added for the purpose of maintaining a high current efficiency.

In the above-stated manner, ammonium persulfate is obtained at a high current efficiency and a high production efficiency in an industrially advantageous manner.

In the following, detailed description will be given of the process for producing sodium persulfate according to the present invention.

The production process of sodium persulfate according to the present invention comprises at least four steps including (A) electrolysis step, (B) sodium persulfate production step, (C) crystallization and separation step for sodium persulfate and (D) the step of recycling the liquid produced at a cathode to the starting raw material for a anode in the electrolysis step.

An aqueous solution containing ammonium sulfate is used as the starting raw material for an anode in the electrolysis step (A). The operating conditions in this electrolysis step are almost the same as those in the electrolysis step of the process for producing ammonium persulfate except that a free acid may be contained in the starting raw material for an anode.

The sodium persulfate production step (B) is the step of producing sodium persulfate by reacting sodium hydroxide with the liquid produced at the anode as obtained in the preceding step (A). The reactor to be used for the reaction is not specifically limited provided that it is usable under reduced pressure, and may be equipped with an agitator. The amount of the sodium hydroxide to be added to the liquid produced at the anode is the amount at least necessary to turn all the hydrogen ions and ammonium ions that are contained in said liquid to sodium ions. The reaction temperature is preferably 15 to 60° C., more preferably 20 to 50° C. The reaction temperature, when being lower than said range, brings about such adverse influences as the deposition of ammonium persulfate crystal and the like, thus causing difficulty in the reaction operation and also insufficiency in the reaction. On the contrary, the reaction temperature, when being higher than said range, brings about decomposition of the persulfates resulting in low yield of the objective sodium persulfate.

The reaction pressure is in the range of preferably 10 to 400 mmHg, more preferably 20 to 100 mmHg. By carrying out the reaction under such a reduced pressure, it is made possible to promote the removal of ammonia gas generated in the reaction. The reaction pressure, when being lower than said range, is economically disadvantageous because of much load applied to a vacuum generating power. On the contrary, the reaction pressure, when being higher than said range, unfavorably increases the solubility of the generated ammonia gas in the solution. The reaction time is preferably 30 to 60 minutes, approx. The reaction time longer than said range is economically disadvantageous. It is advantageous that the generated ammonia gas be absorbed in an aqueous solution of sulfuric acid and recycled as a starting raw material for a cathode in the step (A), or as will be stated hereinafter, as a starting raw material for an anode in the step (A), together with the liquid produced at the cathode.

Next, the crystallization separation step for sodium persulfate (C) is the step of subjecting the aqueous solution containing the sodium persulfate as obtained in the preceding step (B) to crystallizing treatment for the separation of the crystal. For the purpose of the aforesaid crystallizing treatment, there is employed a tank type crystallizer which is widely and generally used. The crystallization temperature is preferably 15 to 60° C., more preferably 20 to 50° C. The crystallization temperature, when being lower than said range, is economically disdvantageous since the temperature of the condenser portion is made unreasonably low, whereas the temperature, when being higher than said range, is also unfavorable because of the decomposition of the objective sodium persulfate thus bringing about a fear of lowering the yield thereof as is the case with the reaction step. As the crystallization pressure, there is preferably adopted a pressure at which water boils in the above-mentioned temperature range. The slurry containing the sodium persulfate after the crystallization is separated into crystal and mother liquor by the use of a solid liquid separator such as a centrifugal filter. The crystal thus obtained is dried and made into a finished product usually by using a powder dryer.

On the other hand, it is advantageous to subject the mother liquor as obtained in the foregoing step (C) to sodium sulfate removal treatment and then to recycle, to the step (B), at least part of the mother liquor which has been subjected to sodium sulfate removal treatment. The sodium sulfate removal treatment is the operation of cooling and crystallizing the mother liquor, and separating by precipitation the resultant crystal as sodium sulfate decahydrate. By putting the aforestated sodium sulfate removal treatment into practice, it is made possible to decrease the amount of dissolving water in the step (B). There is used for said treatment, a tank type crystallizer equipped with a cooling apparatus, which is typified by a tank type cooling crystallizer widely used in industrial fields at the present time. The cooling crystallizing temperature is preferably 5 to 30° C., more preferably 15 to 25° C. The cooling crystallizing temperature, when being higher than said range, is unfavorable since precipitation of sodium sulfate is made insufficient thereby, thus increasing the amount of dissolving water.

The step (D) is that of recycling the liquid produced at the cathode together with ammonia to the starting raw material for the anode in the step (A). It is preferable in this case to employ the ammonia which has been generated in the step (B). The object of adding ammonia resides mainly in the removal of iron components as impurities in the sulfuric acid as a starting raw material by converting the components to iron hydroxide. The amount of ammonia to be added is an amount necessary for attaining the aforestated object. However, the liquid produced at the cathode to which is added ammonia, need not always become alkaline, but may be weakly acidic.

In the above-stated manner, highly pure sodium persulfate almost free from nitrogen is obtained at a high current efficiency in electrolysis and a high production efficiency in an industrially advantageous manner.

Lastly in the following, detailed description will be given of the process for producing potassium persulfate according to the present invention.

The production process of potassium persulfate according to the present invention comprises at least (A') electrolysis step and (B') potassium persulfate production step.

An aqueous solution containing ammonium sulfate is used as the starting raw material for an anode in the electrolysis step (A'). The operating conditions in this electrolysis step are the same as those in the electrolysis step of the process for producing sodium persulfate.

The potassium persulfate production step (B') is the step of producing potassium persulfate by reacting potassium hydroxide with the liquid produced at the anode as obtained in the preceding step (A'). The reactor to be used for the reaction is not specifically limited provided that it is usable under reduced pressure, and may be equipped with an agitator. The amount of the potassium hydroxide to be added to the liquid produced at the anode is the amount at least necessary to turn all the hydrogen ions and ammonium ions that are contained in said liquid to potassium ions. The operating conditions in this reaction step are the same as those in the step (B) of the process for producing sodium persulfate.

It is advantageous that the ammonia gas generated in the step (B') be absorbed in an aqueous solution of sulfuric acid and recycled as the starting raw material for a cathode in the step (A'), or as the starting raw material for an anode in the step (A'), together with the liquid produced at the cathode.

The aqueous solution containing potassium persulfate as obtained in the preceding step (B')is usually subjected to crystallizing treatment in the step (C')in the same manner as in the step (C) of the above process for producing sodium persulfate, and is separated into crystal and mother liquor by using a solid liquid separator such as a centrifugal filter. The crystal thus obtained is dried and made into a finished product usually by using a powder dryer.

It is advantageous in the present invention to recycle at least part of the mother liquor as obtained in the step (C') to the foregoing step (B').

In the above-stated manner, highly pure potassium persulfate is obtained at a high current efficiency in electrolysis and a high production efficiency in an industrially advantageous manner.

According to the process of the present invention, it is made possible to efficiently produce, in an industrially advantageous manner, ammonium persulfate, sodium persulfate and potassium persulfate that are widely used as a polymerization initiator for polyvinyl chloride and polyacrylonitrile and as a treatment agent for a printed wiring board.

In the following, the present invention will be described in more detail with reference to comparative examples and working examples, which however shall not limit the present invention thereto. The current efficiency in the comparative examples and working examples is represented by the formula: [{persulfate ions formed (mol )×2}/{quantity of electric passage (F)}]×100% , that is, the proportion of the formed persulfate ions to the unit quantity of electric passage. The cell potential is the potential difference between both the electrodes. All concentrations are denoted by weight unless otherwise noted.

EXAMPLE 1

The electrolytic cell used therein was made of transparent polyvinyl chloride and was constituted of an anode chamber and a cathode chamber which were partitioned with a diaphragm plate made of porous neutral alumina that was fixed with a sealing agent made of silicone rubber. Each of the chambers was equipped with a buffer tank also functioning as a cooling tank. The liquid as the starting raw material was fed from the buffer tank to an electrolytic chamber with a tube pump, and the liquid in the electrolytic chamber was returned from the outlet thereof to the buffer tank by overflow. Cooling water was circulated through a glass-made tubular cooler that was inserted in the buffer tank. The anode used therein was composed of two sheets of platinum foils having a width of 1.8 cm and a length of 16 cm (area of 28.8 $cm^2$) The cathode used therein was made of a lead sheet. Both the anode and cathode were installed each about 0.5 cm away from the diaphragm. The direct current for electrolysis was supplied from a variable rectifier. The electrolysis was carried out at a current value of 34.5 A for 4 hours by the use of the starting raw materials each having a chemical composition as described hereunder:

Starting raw material for anode in the form of aqueous solution in an amount of 1395.2 g

| Item | % by weight | amount (g) |
|---|---|---|
| Ammonium sulfate | 43.0 | 600.0 |
| Ammonium thiocyanate | 0.03 | 0.42 |

Starting raw material for cathode in the form of aqueous solution in an amount of 1333.6 g

| Item | % by weight | amount (g) |
|---|---|---|
| Sulfuric acid | 18.9 | 252.4 |
| Ammonium sulfate | 28.4 | 378.8 |

After the electrolysis, there were obtained 1333.8 g of liquid produced at the anode and 1391.0 g of liquid produced at the cathode. The chemical compositions of the resultant liquids were analyzed by titration. The results of the analysis and the operational conditions are given hereunder:

| Item | % by weight | amount (g) |
|---|---|---|
| Liquid produced at the anode | | |
| Ammonium persulfate | 38.3 | 511.2 |
| Ammonium sulfate | 7.50 | 10.00 |
| Sulfuric acid | 1.51 | 20.2. |

-continued

| Item | % by weight | amount (g) |
|---|---|---|
| Liquid produced at the cathode | | |
| Ammonium sulfate | 41.9 | 583.2 |
| Sulfuric acid | 0.91 | 12.6 |
| Operational conditions | | |
| Current efficiency | 87.0% | |
| Cell potential | 6.0 V | |
| Average temperature of liquid at the anode | | 28.7° C. |
| Average temperature of liquid at the cathode | | 29.2° C. |

EXAMPLE 2

Electrolysis was carried out by the use of the electrolytic cell same as that used in Example 1 at a current value of 34.5 A for 4 hours by the use of the starting raw materials each having a chemical composition as described hereunder:

Starting raw material for anode in the form of aqueous solution in an amount of 1677.5 g

| Item | % by weight | amount (g) |
|---|---|---|
| Ammonium persulfate | 3.25 | 54.5 |
| Ammonium sulfate | 37.0 | 621.2 |
| Ammonium thiocyanate | 0.03 | 0.50 |

Starting raw material for cathode in the form of aqueous solution in an amount of 953.4 g

| Item | % by weight | amount (g) |
|---|---|---|
| Sulfuric acid | 265 | 252.5 |

After the electrolysis, there were obtained 1615.9 g of liquid produced at the anode and 1010.4 g of liquid produced at the cathode. The chemical compositions of the resultant liquids were analyzed by titration. The results of the analysis and the operational conditions are given hereunder:

| Item | % by weight | amount (g) |
|---|---|---|
| Liquid produced at the anode | | |
| Ammonium persulfate | 35.0 | 565.6 |
| Ammonium sulfate | 7.50 | 121.2 |
| Sulfuric acid | 1.25 | 20.2. |
| Liquid produced at the cathode | | |
| Ammonium sulfate | 20.2 | 204.1 |
| Sulfuric acid | 1.25 | 12.6 |
| Operational conditions | | |
| Current efficiency | 87.0% | |
| Cell potential | 6.0 V | |
| Average temperature of liquid at the anode | | 28.9° C. |
| Average temperature of liquid at the cathode | | 29.7° C. |

All the resultant liquid produced at the anode was transferred to a tank type crystallizer equipped with an agitator and a condenser, and was subjected to vacuum crystallization at 30° C. at a vacuum of 20 mmHg to precipitate ammonium persulfate. The slurry of ammonium persulfate thus obtained was introduced into a centrifugal filter to separate the slurry into crystal and mother liquor. The crystal thus obtained in an amount of 526.8 g was completely dried to obtain crystalline ammonium persulfate in an amount of 511.0 g having a purity of 99.9% . The recovery rate of the ammonium persulfate thus obtained was 99.9% in the crystallization step.

There was also obtained 403.9 g of mother liquor which was separated from the crystal, and which had a chemical composition as given hereunder:

| Item | % by weight | amount (g) |
|---|---|---|
| Ammonium persulfate | 13.5 | 54.5 |
| Ammonium sulfate | 30.0 | 121.2 |
| Sulfuric acid | 5.00 | 20.2. |

The mother liquor was mixed with the liquid produced at the cathode as obtained in the previous electrolysis to form a mixture, in which were further dissolved 251.7 g of ammonium sulfate and 0.50 g of ammonium thiocyanate. Then the sulfuric acid in the mixed liquid was neutralized with 11.4 g of ammonia gas, and the neutralized mixed-liquid was used as the starting raw material for the anode. The starting raw material for the cathode was prepared otherwise.

Thereafter, electrolysis was carried out at a current value of 34.5 A for 4 hours by the use of the starting raw materials each having a chemical composition as described hereunder:

Starting raw material for anode in the form of aqueous solution in an amount of 1677.9 g which had been prepared from the mother liquor and by recycling the liquid produced at the cathode:

| Item | % by weight | amount (g) |
|---|---|---|
| Ammonium persulfate | 3.25 | 54.5 |
| Ammonium sulfate | 37.0 | 621.2 |
| Ammonium thiocyanate | 0.03 | 0.50 |

Starting raw material for cathode in the form of aqueous solution in an amount of 953.4 g

| Item | % by weight | amount (g) |
|---|---|---|
| Sulfuric acid | 26.5 | 252.5 |

After the electrolysis, there were obtained 1615.5 g of liquid produced at the anode and 1010.9 g of liquid produced at the cathode. The chemical compositions of the resultant liquids were analyzed by titration. The results of the analysis and the operational conditions are given hereunder:

| Item | % by weight | amount (g) |
|---|---|---|
| Liquid produced at the anode | | |
| Ammonium persulfate | 35.0 | 565.6 |
| Ammonium sulfate | 7.50 | 121.2 |
| Sulfuric acid | 1.25 | 20.2. |

-continued

| Item | % by weight | amount (g) |
|---|---|---|
| Liquid produced at the cathode | | |
| Ammonium sulfate | 20.2 | 204.1 |
| Sulfuric acid | 1.25 | 12.6 |
| Operational conditions | | |
| Current efficiency | 87.0% | |
| Cell potential | 6.0 V | |
| Average temperature of liquid at the anode | | 28.3° C. |
| Average temperature of liquid at the cathode | | 29.5° C. |

Comparative Example 1

Electrolysis was carried out by the use of the electrolytic cell same as that used in Example 1 at a current value of 34.5 A for 4 hours by the use of the starting raw materials each having a chemical composition as described hereunder:

Starting raw material for anode in the form of aqueous solution in an amount of 1817.8 g

| Item | % by weight | amount (g) |
|---|---|---|
| Ammonium persulfate | 7.18 | 130.6 |
| Ammonium sulfate | 33.7 | 612.8 |
| Sulfuric acid | 5.81 | 105.7 |
| Ammonium thiocyanate | 0.03 | 0.55 |

Starting raw material for cathode in the form of aqueous solution in an amount of 1526.7 g

| Item | % by weight | amount (g) |
|---|---|---|
| Sulfuric acid | 14.6 | 223.3 |

After the electrolysis, there were obtained 1714.6 g of liquid produced at the anode and 1616.8 g of liquid produced at the cathode. The chemical compositions of the resultant liquids were analyzed by titration. The results of the analysis and the operational conditions are given hereunder:

| Item | % by weight | amount (g) |
|---|---|---|
| Liquid produced at the anode | | |
| Ammonium persulfate | 35.4 | 606.4 |
| Ammonium sulfate | 5.79 | 99.2 |
| Sulfuric acid | 5.58 | 95.6. |
| Liquid produced at the cathode | | |
| Ammonium sulfate | 14.7 | 238.1 |
| Sulfuric acid | 1.79 | 28.9 |
| Operational conditions | | |
| Current efficiency | 81.0% | |
| Cell potential | 6.2 V | |
| Average temperature of liquid at the anode | | 27.1° C. |
| Average temperature of liquid at the cathode | | 28.1° C. |

The current efficiency was lower than those in the foregoing examples by about 6%.

EXAMPLE 3

Electrolysis was carried out by the use of the electrolytic cell same as that used in Example 1 at a current value of 34.5 A for 4 hours by the use of the starting raw materials each having a chemical composition as described hereunder:

Starting raw material for anode in the form of aqueous solution in an amount of 1395.4 g

| Item | % by weight | amount (g) |
|---|---|---|
| Ammonium sulfate | 43.0 | 600.0 |
| Ammonium thiocyanate | 0.03 | 0.42 |

Starting raw material for cathode in the form of aqueous solution in an amount of 1334.0 g

| Item | % by weight | amount (g) |
|---|---|---|
| Sulfuric acid | 18.9 | 252.5 |
| Ammonium sulfate | 28.4 | 378.9 |

After the electrolysis, there were obtained 1333.8 g of liquid produced at the anode and 1391.0 g of liquid produced at the cathode. The chemical compositions of the resultant liquids were analyzed by titration. The results of the analysis and the operational conditions are given hereunder:

| Item | % by weiqht | amount (g) |
|---|---|---|
| Liquid produced at the anode | | |
| Ammonium persulfate | 38.3 | 511.0 |
| Ammonium sulfate | 7.50 | 100.0 |
| Sulfuric acid | 1.51 | 20.2. |
| Liquid produced at the cathode | | |
| Ammonium sulfate | 41.9 | 583.0 |
| Sulfuric acid | 0.91 | 12.6 |
| Operational conditions | | |
| Current efficiency | 87.0% | |
| Cell potential | 6.0 V | |
| Average teinperature of liquid at the anode | | 28.7° C. |
| Average temperature of liquid at the cathode | | 29.2° C. |

The liquid produced at the anode was mixed with the mother liquor from which sodium sulfate was removed and which was circulated through the reaction and crystallization steps. The mother liquor from which sodium sulfate was removed in an amount of 2689.8 g was an aqueous solution containing 990.0 g (36.8% ) of sodium persulfate and 163.2 g (6.1%) of sodium sulfate. The resultant mixture was transferred to a reactor equipped with an agitator, where the mixture was incorporated with 48% concentration of aqueous solution of sodium hydroxide in an amount of 533.7 g that was necessary to turn all of the hydrogen ions and ammonium ions that were contained in said mixture into sodium ions and at the same time, the ammonia gas was completely stripped off at a vacuum of 30 mmHg and at room temperature. The reaction liquid after the ammonia gas was completely stripped off, was transferred to a tank type crystallizer equipped with an agitator and a condenser, and was subjected to vacuum crystallization at 30° C. at a vacuum of 20 mmHg to crystallize sodium persulfate. The stripped ammonia gas was reacted with an aqueous solution of sulfuric acid to recycle as a starting raw material for the cathode.

The slurry of sodium persulfate thus obtained was introduced into a centrifugal filter to separate the slurry into crystal and mother liquor. The crystal thus obtained was completely dried to obtain 529.2 g of crystalline sodium persulfate having a purity of 99.8% . The yield of the sodium persulfate was 99% based on the ammonium persulfate contained in the liquid produced at the anode.

The separated mother liquor in an amount of 3000.0 g containing 990.0 g (33.0%) of sodium persulfate and 300.0 g (10.0%) of sodium sulfate, was introduced in a cooling crystallizer to deposit or crystallize sodium sulfate decahydrate at 18° C. under atmospheric pressure. The slurry containing sodium sulfate decahydrate was introduced into a centrifugal filter to separate the slurry into crystal and mother liquor from which sodium sulfate was removed. The separated sodium sulfate was in an amount of 310.2 g.

Subsequently, electrolysis was carried out at a current value of 34.5 A for 4 hours by the use of the starting raw materials as described hereunder:

Starting raw material for anode in the form of an aqueous solution in an amount of 1395.8 g which was prepared by adding 0.42 g of ammonium thiocyanate to the liquid produced at the cathode in the previous electrolysis and neutralizing the sulfuric acid in the liquid with 4.4 g of ammonia, and which had the following chemical composition.

| Item | % by weight | amount (g) |
|---|---|---|
| Ammonium sulfate | 43.0 | 600.0 |
| Ammonium thiocyanate | 0.03 | 0.42 |

Starting raw material for cathode in the form of aqueous solution in an amount of 1334.0 g which was used in the previous step of ammonia recovery and which had the following chemical composition

| Item | % by weight | amount (g) |
|---|---|---|
| Sulfuric acid | 18.9 | 252.5 |
| Ammonium sulfate | 28.4 | 378.9 |

After the electrolysis, there were obtained 1333.8 g of liquid produced at the anode and 1391.4 g of liquid produced at the cathode. The chemical compositions of the resultant liquids were analyzed by titration. The results of the analysis and the operational conditions are given hereunder:

| Item | % by weiqht | amount (g) |
|---|---|---|
| Liquid produced at the anode | | |
| Ammonium persulfate | 38.3 | 511.0 |
| Ammonium sulfate | 7.50 | 100.0 |
| Sulfuric acid | 1.51 | 20.2. |
| Liquid produced at the cathode | | |
| Ammonium sulfate | 41.9 | 583.0 |
| Sulfuric acid | 0.91 | 12.6 |
| Operational conditions | | |
| Current efficiency | 87.2% | |
| Cell potential | 6.0 V | |
| Average temperature of liquid at the anode | | 28.3° C. |
| Average temperature of liquid at the cathode | | 29.5° C. |

Comparative Example 2

A trial was made to produce sodium persulfate by direct electrolysis in the coexistence of ammonium ions in accordance with the method as described in Japanese Patent Publication No.31190/1980(Sho-55) by the use of the experimental equipment such as an electrolytic cell same as that used in Example 1. The electrolysis was carried out at a current value of 44 A for 2.5 hours by the use of the starting raw materials each having a chemical composition as described hereunder:

Starting raw material for anode in the form of aqueous solution in an amount of 3450 g

| Item | % by weight | amount (g) |
|---|---|---|
| Sodium persulfate | 20.5 | 707.3 |
| Sodium sulfate | 12.1 | 417.5 |
| Ammonium sulfate | 9.81 | 338.4 |
| Sulfuric acid | 0 | 0 |
| Ammonium thiocyanate | 0.03 | 1.04 |

Starting raw material for cathode in the form of aqueous solution in an amount of 950 g

| Item | % by weight | amount (g) |
|---|---|---|
| Sulfuric acid | 29.7 | 282.2 |

After the electrolysis, there were obtained 3300 g of liquid produced at the anode and 1000 g of liquid produced at the cathode. The chemical compositions of the resultant liquids were analyzed by titration. The results of the analysis and the operational conditions are given hereunder:

| Item | % by weiqht | amount (g) |
|---|---|---|
| Liquid produced at the anode | | |
| Sodium persulfate | 34.5 | 1138.0 |
| Sodium sulfate | 0.5 | 16.5 |
| Ammonium sulfate | 8.1 | 267.3 |
| Sulfuric acid | 1.1 | 36.3. |
| Liquid produced at the cathode | | |
| Sodium sulfate | 12.6 | 126.0 |
| Ammonium sulfate | 6.78 | 67.8 |
| Sulfuric acid | 6.2 | 62.0 |
| Operational conditions | | |
| Current efficiency | 80.3% | |
| Cell potential | 7.9 V | |
| Average temperature of liquid at the anode | | 33.3° C. |
| Average temperature of liquid at the cathode | | 38° C. |

By the use of a reactor same as that used in Example 3, the liquid produced at the anode was incorporated with 48% concentration of aqueous solution of sodium hydroxide in an amount necessary to neutralize the sulfuric acid contained in the liquid produced at the anode that had been obtained by the electrolysis. The resultant neutralized liquid was subjected to vacuum crystallization at 30° C. at a vacuum of 20 mmHg to precipitate sodium persulfate.

The slurry of sodium persulfate thus obtained was introduced into a centrifugal filter to separate the slurry into crystal and mother liquor. The crystal thus obtained was completely dried to produce 450 g of crystalline sodium persulfate having a purity of 98.0% with a nitrogen content of 0.2% .

The results of the direct electrolysis process revealed a current efficiency of about 80% and a low purity of the crystal obtained by crystallization. Moreover, in order to obtain the crystal having a purity as high as that in Example 1, it was required to carry out minute and attentive cleaning by using a saturated solution of sodium persulfate which had been made sightly alkaline with sodium hydroxide. In addition, the final yield of the objective sodium persulfate produced by electrolysis was 95% , which was lowered by the cleaning.

Comparative Example 3

A trial was made to produce sodium persulfate through a general conventional process by reacting ammonium persulfate and sodium hydroxide by using the electrolytic cell same as that used in Example 1. The electrolysis was carried out at a current value of 34.5 A for 4 hours by the use of the starting raw materials each having a chemical composition as described hereunder:

Starting raw material for anode in the form of aqueous solution in an amount of 1817.8 g

| Item | % by weight | amount (g) |
|---|---|---|
| Ammonium persulfate | 7.18 | 130.6 |
| Ammonium sulfate | 33.7 | 612.8 |
| Sulfuric acid | 5.81 | 105.7 |
| Ammonium thiocyanate | 0.03 | 0.55 |

Starting raw material for cathode in the form of aqueous solution in an amount of 1526.7 g

| Item | % by weight | amount (g) |
|---|---|---|
| Sulfuric acid | 14.6 | 223.3 |

After the electrolysis, there were obtained 1714.6 g of liquid produced at the anode and 1616.8 g of liquid produced at the cathode. The chemical compositions of the resultant liquids were analyzed by titration. The results of the analysis and the operational conditions are given hereunder:

| Item | % by weight | amount (g) |
|---|---|---|
| Liquid produced at the anode | | |
| Ammonium persulfate | 35.4 | 606.4 |
| Ammonium sulfate | 5.79 | 99.2 |
| Sulfuric acid | 5.58 | 95.6. |
| Liquid produced at the cathode | | |
| Ammonium sulfate | 14.7 | 238.1 |
| Sulfuric acid | 1.79 | 28.9 |
| Operational conditions | | |
| Current efficiency | 81.0% | |
| Cell potential | 6.2 V | |
| Average temperature of liquid at the anode | | 27° C. |
| Average temperature of liquid at the cathode | | 28° C. |

The liquid produced at the anode thus obtained was subjected to vacuum crystallization at 30° C. at a vacuum of 20 mmHg to precipitate ammonium persulfate. The slurry of ammonium persulfate thus obtained was introduced into a centrifugal filter to separate the slurry into crystal and mother liquor. The hydrous crystal thus obtained was re-dissolved and was incorporated with 48% concentration of aqueous solution of sodium hydroxide to proceed with the reaction. From the solution, crystalline sodium persulfate was separated and recovered, and then was completely dried. As a result, there was obtained 474.0 g of crystalline sodium persulfate having a purity of 99.5% at a yield of 95% based on the ammonium persulfate in the liquid produced at the anode. In conclusion, the current efficiency was lower than that in the above-described examples according to the present invention by about 6% (87.4–81.8), and further, the yield of the objective sodium persulfate produced by electrolysis on the basis of the ammonium persulfate was lower than that in the examples according to the present invention by about 4% (99–95)

EXAMPLE 4

Electrolysis was carried out by the use of the electrolytic cell same as that used in Example 1 at a current value of 34.5 A for 4 hours by the use of the starting raw materials each having a chemical composition as described hereunder:

Starting raw material for anode in the form of aqueous solution in an amount of 1395.2 g

| Item | % by weight | amount (g) |
|---|---|---|
| Ammonium persulfate | 43.0 | 600.0 |
| Ammonium thiocyanate | 0.03 | 0.42 |

Starting raw material for cathode in the form of aqueous solution in an amount of 1333.6 g

| Item | % by weight | amount (g) |
|---|---|---|
| Sulfuric acid | 18.9 | 252.5 |
| Ammonium sulfate | 28.4 | 378.8 |

After the electrolysis, there were obtained 1333.8 g of liquid produced at the anode and 1391.0 g of liquid produced at the cathode. The chemical compositions of the resultant liquids were analyzed by titration. The results of the analysis and the operational conditions are given hereunder:

| Item | % by weight | amount (g) |
|---|---|---|
| Liquid produced at the anode | | |
| Ammonium persulfate | 38.3 | 511.2 |
| Ammonium sulfate | 7.50 | 100.0 |
| Sulfuric acid | 1.51 | 20.2. |
| Liquid produced at the cathode | | |
| Ammonium sulfate | 41.9 | 583.0 |
| Sulfuric acid | 0.91 | 12.6 |
| Operational conditions | | |
| Current efficiency | 87.0% | |
| Cell potential | 6.0 V | |
| Average temperature of liquid at the anode | | 28.7° C. |
| Average temperature of liquid at the cathode | | 29.2° C. |

The liquid produced at the anode was mixed with the mother liquor from which was circulated through the reaction and crystallization steps. 8388.1 g of the mother liquor was an aqueous solution containing 218.1 g (2.60%) of potassium persulfate and 838.8 g (10.0%) of potassium sulfate. The resultant mixture was transferred to a reactor equipped with an agitator, where the mixture was incorporated with 35% concentration of aqueous solution of potassium hydroxide in an amount of 1024.9 g that was necessary to turn all of the hydrogen ions and ammonium ions that were contained in said mixture into potassium ions and at the same time, the ammonia gas was completely stripped off at a vacuum of 30 mmHg and at room temperature. The reaction liquid after the ammonia gas was completely stripped off, was transferred to a tank type crystallizer equipped with an agitator and a condenser, and was subjected to vacuum crystallization at 30° C. at a vacuum of 20 mmHg to precipitate potassium persulfate.

The slurry of potassium persulfate thus obtained was introduced into a centrifugal filter to separate the slurry into crystal and mother liquor. The crystal thus obtained was completely dried to obtain 557.1 g of crystalline potassium persulfate having a purity of 99.8% . The yield of the potassium persulfate was 99% based on the ammonium persulfate contained in the liquid produced at the anode.

Comparative Example 4

A trial was made to produce potassium persulfate through a general conventional process by reacting ammonium persulfate and potassium hydroxide by using the electrolytic cell same as that used in Example 1. The electrolysis was carried out at a current value of 34.5 A for 4 hours by the use of the starting raw materials each having a chemical composition as described hereunder:

Starting raw material for anode in the form of aqueous solution in an amount of 1817.8 g

| Item | % by weight | amount (g) |
|---|---|---|
| Ammonium persulfate | 7.18 | 130.6 |
| Ammonium sulfate | 33.7 | 612.8 |
| Sulfuric acid | 5.81 | 105.7 |
| Ammonium thiocyanate | 0.03 | 0.55 |

Starting raw material for cathode in the form of aqueous solution in an amount of 1526.7 g

| Item | % by weight | amount (g) |
|---|---|---|
| Sulfuric acid | 14.6 | 223.3 |

After the electrolysis, there were obtained 1714.6 g of liquid produced at the anode and 1616.8 g of liquid produced at the cathode. The chemical compositions of the resultant liquids were analyzed by titration. The results of the analysis and the operational conditions are given hereunder:

| Item | % by weight | amount (g) |
|---|---|---|
| Liquid produced at the anode | | |
| Ammonium persulfate | 35.4 | 606.4 |
| Ammonium sulfate | 5.79 | 99.2 |
| Sulfuric acid | 5.58 | 95.6. |
| Liquid produced at the cathode | | |
| Ammonium sulfate | 14.7 | 238.1 |
| Sulfuric acid | 1.79 | 28.9 |

-continued

| Item | % by weight | amount (g) |
|---|---|---|
| Operational conditions | | |
| Current efficiency | 81.0% | |
| Cell potential | 6.2 V | |
| Average temperature of liquid at the anode | | 27.1° C. |
| Average temperature of liquid at the cathode | | 28.1° C. |

The liquid produced at the anode thus obtained was subjected to vacuum crystallization at 30° C. at a vacuum of 20 mmHg to precipitate ammonium persulfate. The slurry of ammonium persulfate thus obtained was introduced into a centrifugal filter to separate the slurry into crystal and mother liquor. The hydrous crystal thus obtained was re-dissolved and was incorporated with 48% concentration of aqueous solution of potassium hydroxide to proceed with the reaction. From the solution, crystalline potassium persulfate was separated and recovered, and then was completely dried. As a result, there was obtained 538.1 g of crystalline potassium persulfate having a purity of 99.5% at a yield of 95% based on the ammonium persulfate in the liquid produced at the anode. In conclusion, the current efficiency was lower than that in the above-described examples according to the present invention by about 6% (87.4–81.8), and further, the yield of the objective potassium persulfate produced by electrolysis on the basis of the ammonium persulfate was lower than that in the examples according to the present invention by about 4% (99–95)

What is claimed is:

1. A process for producing ammonium persulfate which comprises electrolyzing an aqueous solution containing sulfate ions and ammonium ions as the starting raw material for an anode, then crystallizing the electrolyzed product, and separating the crystal from mother liquor, said starting raw material for an anode being composed of an aqueous solution of ammonium sulfate wherein the ammonium ions are present in an amount of at least one equivalent (two-fold moles) based on the sulfate ions, the sulfate ions of said aqueous solution of the starting raw material originating only from the ammonium sulfate.

2. The process for producing ammonium persulfate according to claim 1, wherein the aqueous solution of ammonium sulfate contains 30 to 44% by weight of ammonium sulfate.

3. The process for producing ammonium persulfate according to claim 1, wherein the electrolysis is carried out at a current density of at least 40 $A/dm^2$ on the surface of the anode.

4. The process for producing ammonium persulfate according to claim 1, wherein the electrolysis is carried out at a temperature in the range of 15 to 40° C.

5. The process for producing ammonium persulfate according to claim 1, wherein the mixture of the liquid produces at a cathode and the mother liquor is neutralized with ammonia, and the neutralized mixture is used as the starting raw material for the anode.

6. The process for producing ammonium persulfate according to claim 1, wherein the starting raw material for the anode consists essentially of the aqueous solution of ammonium sulfate.

7. The process for producing ammonium persulfate according to claim 6, wherein the starting raw material for the anode further includes a polarizer.

8. The process for producing ammonium persulfate according to claim 6, wherein starting raw material for the cathode is sulfuric acid.

9. The process for producing ammonium persulfate according to claim 1, wherein the aqueous solution is free of free sulfuric acid.

10. A process for producing sodium persulfate which comprises the step (A) of electrolyzing an aqueous solution containing ammonium sulfate at an anode, the aqueous solution being starting raw material for the anode, with all sulfate ions in the aqueous solution originating from the ammonium sulfate; the step (B) of producing sodium persulfate from the liquid produced at the anode as obtained in the preceding step (A) and sodium hydroxide; the step (C) of crystallizing the aqueous solution containing sodium persulfate as obtained in the preceding step (B), and separating the resultant crystal from mother liquor; and the step (D) of recycling the liquid produced at a cathode together with ammonia to the starting raw material for the anode in the step (A).

11. The process for producing sodium persulfate according to claim 10, wherein said electrolyzing is performed in an electrolytic cell having only two chambers, separated by a diaphragm or ion-exchange membrane, with the anode and cathode being in respective chambers and separated by the diaphragm or ion-exchange membrane.

12. The process for producing sodium persulfate according to claim 10, wherein the aqueous solution containing ammonium sulfate in the step (A) contains 30 to 44% by weight of ammonium sulfate.

13. The process for producing sodium persulfate according to claim 10, wherein the electrolysis in the step (A) is carried out at a current density of at least 40 $A/dm^2$ on the surface of the anode.

14. The process for producing sodium persulfate according to claim 10, wherein the electrolysis in the step (A) is carried out at a temperature in the range of 15 to 40° C.

15. The process for producing sodium persulfate according to claim 10, wherein the temperature in the step (B) is in the range of 15 to 60° C. and the pressure therein is in the range of 10 to 400 mmHg.

16. The process for producing sodium persulfate according to claim 10, wherein part or all of the solution produced by removing sodium sulfate from the mother liquor in the step (C) is recycled to the step (B).

17. A process for producing potassium persulfate which comprises the step (A') of electrolyzing an aqueous solution containing ammonium sulfate at an anode, the aqueous solution being starting raw material for the anode, with all sulfate ions in the aqueous solution originating from the ammonium sulfate; and the step (B') of producing potassium persulfate from the liquid produced at the anode in the step (A') and potassium hydroxide.

18. The process for producing potassium persulfate according to claim 17 which further comprises, subsequent to the step (B'), the step (C') of crystallizing the aqueous solution of potassium persulfate formed in the step (B'), and separating the resultant crystal from mother liquor.

19. The process for producing potassium persulfate according to claim 18, wherein at least part of the mother liquor as formed in the step (C') is recycled to the step (B').

20. The process for producing potassium persulfate according to claim 17, wherein the aqueous solution containing ammonium sulfate as the starting material at an anode in the step (A') contains 30 to 44% by weight of ammonium sulfate.

21. The process for producing potassium persulfate according to claim 17, wherein the electrolysis in the step (A') is carried out at a current density of at least 40 $A/dm^2$ at the surface of the anode.

22. The process for producing potassium persulfate according to claim 17, wherein the electrolysis in the step (A') is carried out at a temperature in the range of 15 to 40° C.

23. The process for producing potassium persulfate according to claim 17, wherein the production step of potassium persulfate in the step (B') is carried out at a temperature in the range of 15 to 60° C. at a pressure in the range of 10 to 400 mmHg.

24. The process for producing potassium persulfate according to claim 17, wherein the liquid produced at a cathode in the step (A') together with ammonia are employed as the starting raw material in the step (A').

25. The process for producing potassium persulfate according to claim 17, wherein said electrolyzing is performed in an electrolytic cell having only two chambers, separated by a diaphragm or ion-exchange membrane, with the anode and cathode being in respective chambers and separated by the diaphragm or ion-exchange membrane.

* * * * *